US008783158B2

(12) United States Patent
Kerbrat et al.

(10) Patent No.: US 8,783,158 B2
(45) Date of Patent: Jul. 22, 2014

(54) DELAYED BLOWBACK FIREARMS WITH NOVEL MECHANISMS FOR CONTROL OF RECOIL AND MUZZLE CLIMB

(71) Applicant: KRISS Systems SA, Nyon (CH)

(72) Inventors: Renaud Kerbrat, Gland (CH); Antoine Robert, Morges (CH); Jan Henrik Jebsen, Crans-pres-Celigny (CH)

(73) Assignee: KRISS Systems SA, Nyon (CH)

( * ) Notice: Subject to any disclaimer, the term of this patent is extended or adjusted under 35 U.S.C. 154(b) by 0 days.

(21) Appl. No.: 13/840,261

(22) Filed: Mar. 15, 2013

(65) Prior Publication Data

US 2013/0199069 A1 Aug. 8, 2013

Related U.S. Application Data

(63) Continuation of application No. 13/645,708, filed on Oct. 5, 2012, now abandoned, and a continuation of application No. 12/539,276, filed on Aug. 11, 2009, now Pat. No. 8,281,704.

(30) Foreign Application Priority Data

Oct. 9, 2008 (CH) ..... 01603/08

(51) Int. Cl.
*F41A 3/38* (2006.01)

(52) U.S. Cl.
CPC ..... *F41A 3/38* (2013.01)
USPC ..... 89/168; 89/175; 89/176

(58) Field of Classification Search
CPC ..... F41A 3/36; F41A 3/38; F41A 3/40; F41A 3/50
USPC ..... 89/164, 168, 169, 175, 176, 189, 190
See application file for complete search history.

(56) References Cited

U.S. PATENT DOCUMENTS

| | | | | |
|---|---|---|---|---|
| 1,029,720 | A | 6/1912 | Schellenger | |
| 1,746,471 | A | 2/1930 | Fritz et al. | |
| 2,600,007 | A * | 6/1952 | Lippert et al. | 89/176 |
| 3,890,881 | A * | 6/1975 | Hurlemann et al. | 89/176 |
| 3,960,053 | A * | 6/1976 | Conley | 89/149 |
| 4,015,512 | A * | 4/1977 | Feerick | 89/190 |
| 4,126,079 | A | 11/1978 | Perrine | |
| 4,467,698 | A | 8/1984 | Perrine | |
| 7,107,715 | B2 | 9/2006 | Keeney et al. | |
| 7,201,094 | B2 | 4/2007 | Jebsen et al. | |
| 7,698,987 | B2 | 4/2010 | Jebsen et al. | |

FOREIGN PATENT DOCUMENTS

WO 0227258 A2 4/2002

OTHER PUBLICATIONS

International Search Report, International PCT Application No. PCT/IB2009/054435, dated Dec. 29, 2009.

* cited by examiner

*Primary Examiner* — Stephen M Johnson
(74) *Attorney, Agent, or Firm* — Wiley Rein LLP

(57) ABSTRACT

The mechanism comprises a main frame (1) and its extension (1'), which accommodate a barrel (21) with fixed mounting, a mobile bolt (22) and its guiding pin ensemble (66) and main spring (67) moving in the main frame (1), a mobile mass (34) and its assembly of guiding pin (60), push plate (61) and return spring (62), and a mobile mass catch sear (42) and its spring (7). The mobile mass pivots from a first position under the barrel to a downward position in reaction to the backward movement of the mobile bolt. The placement of the mobile mass in front of the chamber directs counteracting forces down on the barrel to prevent muzzle climb during operation.

10 Claims, 7 Drawing Sheets

Fig:4a
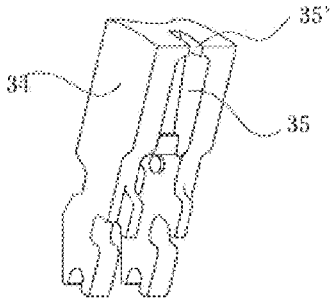
Fig:4b
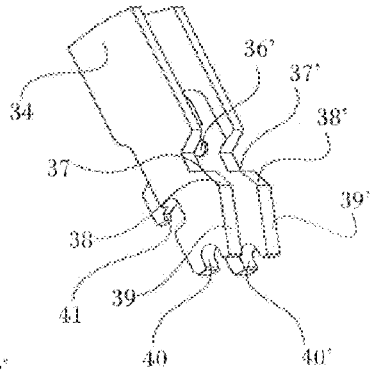
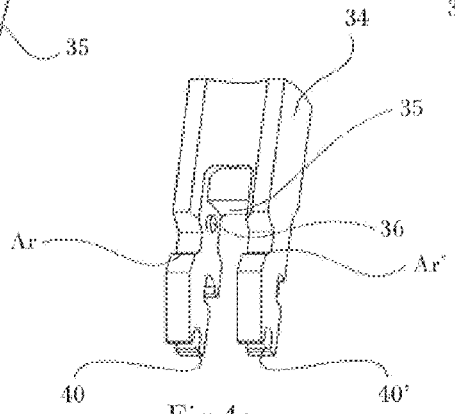
Fig:4c
Fig:5a
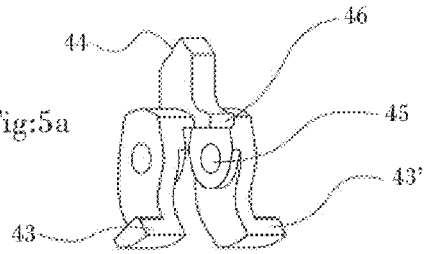
Fig:5b
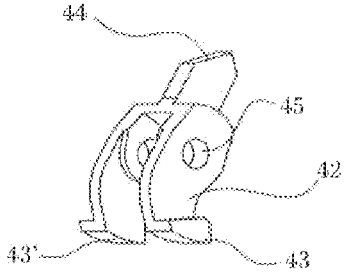
Fig:6a
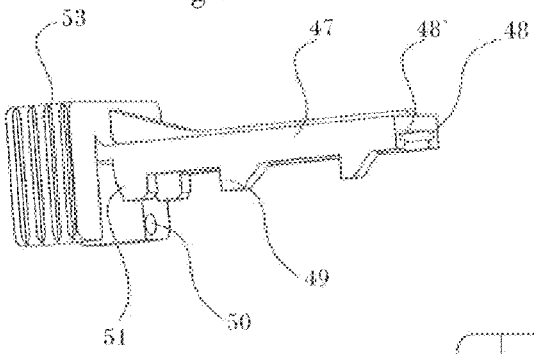
Fig:6b
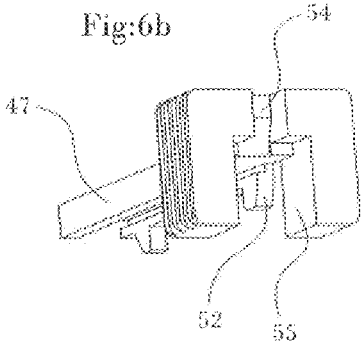
Fig:7
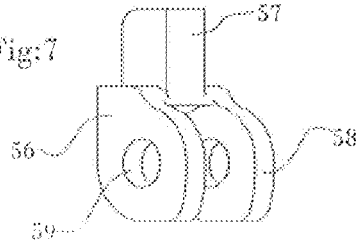

DELAYED BLOWBACK FIREARMS WITH NOVEL MECHANISMS FOR CONTROL OF RECOIL AND MUZZLE CLIMB

REFERENCE TO RELATED APPLICATIONS

This application is a continuation of U.S. application Ser. No. 13/645,708 filed Oct. 5, 2012 (now pending) and U.S. application Ser. No. 12/539,276 filed Aug. 11, 2009 (now U.S. Pat. No. 8,281,704), which claims priority benefit to Switzerland national application 01603/08 filed Oct. 9, 2008, the entire contents of which are incorporated herein by reference.

BACKGROUND AND INTRODUCTION

The invention concerns a delayed blowback firearm comprising a novel mechanism for reducing muzzle climb and attenuating recoil. The novel device resides forward of the bolt head and below the barrel and employs a mobile mass that reacts to firing in a manner to counteract recoil and muzzle jump forces in order to improve the handling and control of the firearm in use. Automatic and semi-automatic firearms, rifles, and pistols, can be fitted with the novel mechanism.

For some time there have been a number of mechanical systems available that are based on the principle of delayed blowback. All of them have been adapted for light automatic and/or semi-automatic firearms. These systems can be classified in three main categories and one sub-category, which are:

a) The delayed blowback of the bolt by inertia, known as the blowback bolt. In this case, the delayed blowback effect is generated solely by the weight of the mobile bolt and the force of a spring.
b) The delayed blowback of the bolt by means of a lever, slope and/or use of gas. Apart from those that use gas, these more complicated systems are paradoxically as old as automatic firearms with blowback bolts. Their advantage lies in better control of forces and a significant reduction in the weight and volume of firearms designed and built using these systems.
c) Delayed bolt blowback using a braking system. This last category will not be covered since it was abandoned long ago by the gunsmithing industry.

In the majority of cases, and with regards to the second category of systems, the mechanism for delayed blowback generally consists of three to five mobile parts, the only exception being for the sub-category of firearms using the principle of gas delayed blowback devices that use only a single mobile part (the functioning principle of Volkssturmgewehr). This last system is however rarely used and represents a very small share of global production of automatic pistols.

All these systems with delayed blowback each have the drawbacks inherent at the time of their conception, the end of the 19th and beginning of the 20th century. At this period, the chemistry of smokeless powder was still in its early stages. Combustion time and gas volume (hence pressure) generated by these powders imposed specific mechanical solutions relative to the state of metallurgy of the time. At the dawn of the 21st century, while the science and technology of powders and explosives have continued to evolve, we still use the same mechanisms, practically unchanged, which have now become totally unsuitable for these modern powders.

The simple blowback bolt has long been used to good advantage to design simple, easy-to-use, often low-cost automatic firearms. However, this particular system is suitable only for the use of relatively low power ammunition, as used by hand guns. Even with this kind of ammunition, the gun needs to have a heavy bolt to ensure that the projectile maintains acceptable ballistic characteristics. The need to use relatively heavy bolts imposes minimum volumes and dimensions that make the firearm heavy and cumbersome compared to the power of ammunition used. A few, rare automatic pistols have been designed and produced incorporating this first system, but the volume and weight constraints call for a powerful spring to compensate for reduced bolt weight, making the gun particularly difficult to handle. If this configuration is perfect for the design of small caliber automatic pistols (6.35 mm, 7.65 mm) it reaches its limits with the world's most commonly used ammunition for handguns, the 9 mm Parabellum. It is unusable for another major handgun caliber, the famous 11.43 mm or .45 calibers. As history confirms, no pistol functioning according to the blowback bolt principle has ever been produced for this ammunition.

The second category of delayed blowback systems uses an amplification lever, oblique helicoidal ramps or other slopes—the list is not exhaustive since there are so many variants. All these systems have a prime objective: to create a mechanical demultiplier of opposable force to that generated by the explosion of the powder charge contained in the cartridge. The second objective, consequence of the first, is to reduce the weight and volume of the total mass of the mobile unit that comprises the bolt. But a demultiplication effect becomes inversely overdrive, since the mobile unit of the gun is lighter so that it moves at a speed corresponding to overdrive ratio during the firing of the shot. This ratio is effectively variable but generally oscillates between 1:3 and 1:4 in function of the ammunition used (this system can be used for all types of ammunition). In consequence, the mobile unit paradoxically ends its movement in the receiver with energy that is much greater than the single mass of a blowback bolt. If, in the case of a machine gun pistol or heavier firearm, this energy can be dissipated by some kind of shock-absorbing device, or simply by a longer movement of the whole ensemble, these options are not available in an automatic pistol where the total passage of this mobile unit or bolt is mechanically and physically limited. The consequence of this short space is an abrupt stop of the mobile unit at the end of its course while its energy is still considerable. This provokes recoil and muzzle jump of the firearm that are prejudicial to its control and precision. This phenomenon is common to all automatic pistols, without exception, notably those functioning according to the principle of short recoil and barrel tilt wrongly referred to as the 'Browning system' which represents nearly 80% of global production of automatic pistols.

In all cases, and whichever of the systems described above is employed, in mechanical terms, they no longer meet the advantages offered by modern ammunition.

SUMMARY OF THE INVENTION

The object of this invention is a delayed blowback firearm with a mechanism that is adapted to modern ammunition and which makes it possible to reduce muzzle climb and correspondingly reduce recoil on firing. The mechanism that distinguishes this invention is based on the principle of delayed bolt blowback and functions in a way that is quite distinct from the existing systems described previously. The invention combines solutions to several mechanical and physico-dynamic problems in a light automatic or semi-automatic firearm or pistol using modern ammunition. As stated before, modern ammunition has a speed, thus an inflammation time, which is considerably shorter than those existing when the principal systems used today in 'modern' pistols were invented. This important characteristic makes it possible to dispense with these old mechanisms designed to keep the bolt closed for long enough to allow complete powder combustion since this problem no longer exists today. Modern powders have a velocity of nearly 2/1000th second, which is at least 2.5 times faster than powders of mid-20th century. The mechanism that characterizes this invention makes it possible to significantly reduce the time of bolt restraint at the point of powder charge or explosion. To accomplish this reduction in time, the invention makes use of a mobile mass, rather than a lock, which acts in part as a blowback brake. This has the advantage of being easily controllable because its movement is physically dissociated from that of the mobile bolt and, above all, because the inert mass of the mobile bolt and the point of inertia for the mobile mass act according to different directions and speeds.

The mechanism characterizing this invention allows much better control of excess energy produced by powder ignition by dividing and re-directing the forces produced at firing and deflagration. This advantage makes it possible to make more compact and/or lighter parts than those of an automatic pistol functioning according to the Browning, Walther, or other systems based on short barrel recoil (e.g. Steyr) or classic delayed blowback (e.g. Heckler & Koch) and in which their mobile units (often called transporters) or bolts, move after the departure of the shot, in a generally linear way, in (or on, in the case of pistols) the frame of the firearm. These relatively heavy mobile units, which stop abruptly at the end of their course, are at the origin of more than 60 to 70% of the firearm's recoil force (mechanical recoil). The other 30 to 40% are due to the blast provoked by the violent escape of gas from the barrel (dynamic recoil). The mechanism described in this invention has the advantage of making it possible to reduce the weight of the mobile bolt, the only component effecting a rearward translation on the X axis along the barrel, by at least 100 grams.

Advantageously, the mobile bolt that can be used in the mechanism characterizing this invention is or can be three times lighter than a transporter (bolt) of a classic modern pistol, of which we have cited some names by way of example above. As a result, there is minimal recoil and muzzle climb since the receiver is required to stop a mobile bolt being able to weigh less than 100 grams and traveling at a speed no greater than that of a classic firearm, and since its energy has been essentially dissipated in the propulsion of a novel mobile mass apparatus, by means that will be described below. The laws of physics are inescapable. The mobile mass has a similar weight to that of the mobile bolt, although this can be easily modified to increase or reduce the operational cycle time (firing rate). As such, the mobile mass as described here is the principal means for controlling energy.

Another advantage of this invention is that the mobile mass undergoes an acceleration that is equivalent to the value of the primary angle of its slopes that contact that of the mobile bolt. This is the second means of energy control and the mobile mass can thus propelled at a speed from about 3.5 to more than 4 times greater than that of the mobile bolt (depending on ammunition used for the same barrel length). The third means of energy control is the strength of the mobile mass return spring, which is an important element for the functioning of the mechanism. These characteristics of the invention make it possible to transfer the mobile mass's point of inertia to the whole firearm and thus to the hand and arm of the operator. This movement, from top to bottom, transmitted throughout the whole firearm makes it possible to significantly reduce the muzzle climb provoked by firing.

A further advantage lies in the fact that the amount of energy dissipated by the action of the mobile mass, as it stops suddenly in its course, is subtracted from that of the inertial mass of the mobile bolt. So, at the end of its course, the mobile mass gives back considerably more energy than that dissipated by the mobile bolt in its backward journey (stroke) and abrupt stop in the receiver. The mobile mass effects a downward pivot force in relation to the X axis of the barrel, making it possible to release its energy in a direction which is definitely perpendicular to the axis of the barrel as well as the initial pressure of the mobile bolt, and making it possible to generate a dynamic effect in counter balance to the natural muzzle climb of the firearm, especially during automatic firing. The mechanism characterizing this invention can also include a catch device at the end of the course of the mobile mass. This catch unit or sear has two distinct functions: first, it stops the mobile mass in a low or down position and prevents it rebounding at the point of its abrupt stop in the extension of the receiver. This is designed to allow the transfer of all of its energy and prevent rebounding forces. The second function of this catch sear is to hold the mobile mass until the bolt has returned to firing position. If, for whatever reason, the bolt does not go back to its initial position, the mass will not be released.

A firearm designed using the mechanical principles that characterize this invention also has the advantage of a fixed barrel that does not directly participate in the functioning of the firearm—in other words, no barrel recoil is not required. Thus, the barrel can be simply screwed, pinned, or fixed using some kind of system common to the state of the art in this area. This characteristic guarantees high precision in a firearm, the barrel being mounted on a piece within the main frame, the same piece that can support the sights and other accessories. The main frame can easily accommodate on its upper part, either by manufacture or fabrication, a system of special sights or accessories, such as those compatible with 'Picatinny rail' type of accessories. The main frame is connected to the lower part of the firearm, preferably with a triggering mechanism and trigger and trigger guard, as for example, in common pistol or rifle manufacture. Any existing trigger assembly and firing mechanism and associated assembly method could be selected for a suitable use with the firearm mechanisms of the invention.

In another advantage brought about by this invention, the dimensions of the mobile bolt in particular and the mobile parts in general allows for the design of light, compact firearms. And a further benefit characterizing this invention lies in the fact that, particularly for an automatic pistol, the axis of the barrel can be positioned very low in comparison to that of other pistols of the same caliber. The mechanism characterizing this invention allows a reduction of nearly 15% in this distance compared to classic arms design. This results in a further possibility for reducing significantly the muzzle climb of the gun, given that the primary pivotal axis of the firearm is the firer's hand or wrist joint. This natural pivotal axis is invariably positioned under the axis of the barrel for obvious ergonomic and morphological reasons. The reduction of the distance between the horizontal axis of the barrel and the pivotal point of the firer's hand also has a direct influence on the phenomenon of muzzle climb as the bullet is fired.

In various embodiments, a firearm of the invention includes a counteracting mobile mass that is designed to offset the muzzle climb recoil forces famous in a variety of firearms, especially when operated in automatic firing or burst firing modes. While not limited to an automatic firearm, the invention can be most appreciated when joined with a semi-automatic or automatic action. As stated, the mobile mass is configured to move in reaction to firing and to counter the recoil forces upon firing. Typically, a firearm of the invention includes as basic recoil controlling aspects a barrel with a cartridge-chambering end and a firing end, as is conventional. A mobile bolt configured to move along the axis of the barrel from a forward to a rearward position, or in translational movement along the axis defined by the barrel is also included. The mobile mass is generally configured to pivot from a upward and cocked position under the barrel, and generally forward of the chambering end of the barrel, to pivot to a lower or downward position. The mobile mass and mobile bolt each have at least one surface that forms a contact between them, a contact that ultimately directs the mobile mass to pivot downward. There are preferably more than one contact surfaces on the mobile mass, but both the mobile mass and mobile bolt can be designed with various contact surfaces. The contact surface of the mobile bolt can be in the form of a projection that extends forward of the bolt head, the forward projection including a region designed to contact the mobile mass with an angled or sloped surface. A firearm also includes a receiver and in the case of the invention here comprises a top main frame part of a receiver that is configured to allow the movement of the mobile mass from a forward-most cocked position to a rearward position, while also preferably confining the mobile bolt within the axis of the barrel. This top main frame part of the receiver further includes at least one forward extension assembly for fixing a barrel and for connecting the mobile mass below the barrel and forward of the chambering end of the barrel. A connection point for the mobile mass on the extension allows the mobile mass to pivot. A further pivot point on the extension can be used for a mobile mass return spring or restraining device, so that the mobile mass and the assembly that confines and directs its pivoting movement are both connected to the extension, and preferably by separate pivot point on the extension.

The mobile bolt itself includes in a preferred embodiment a projection that is the surface that contacts the mobile mass, which projection contacts the mobile mass at a first angled surface of the mobile mass. Upon firing of the firearm, the contact or action of the mobile bolt projection pushing against the first angled surface of the mobile mass directs the pivoting movement of the mobile mass downward, and preferably away from the barrel. This downward movement of the mobile mass counteracts the muzzle climb and recoil forces upon firing.

In more particular embodiments, the first angled surface of the mobile mass joins a surface of the mobile bolt, or projection of the mobile bolt, so that substantially no gaps exist along the length of the first angled surface in the loaded or cocked position. In other embodiments, the mobile mass has more than one angled surface, such as first and second angled surfaces, the first angled surface contacting a surface of the mobile bolt immediately after firing and/or in the cocked or loaded position. The firearm can include a main spring linked to the mobile bolt and configured to assist the backward to forward movement of the mobile bolt during cycling. The firearm can also have a spring linked to the mobile mass, the spring configured to assist the pivot movement from a lower position to an upward position. This spring can also dissipate some of the recoil forces. A particular embodiment also includes a spring-loaded catch sear within a mobile mass assembly. It is a spring-loaded catch sear in that part of the movement of the catch sear is resisted and/or assisted by a spring or other resistance device. The catch sear, in any embodiment, is linked to the mobile mass and is capable of temporarily restraining, or in some embodiments locking, the mobile mass from pivoting upward into a loaded position. This can be a safety mechanism to prevent movement of parts when proper loading or chambering is somehow prevented.

The design of the mobile mass and its connection to the frame can be one of many selected by the designer, based upon many factors. In one option, the pivoting movement of the mobile mass is in the same plane defined by the barrel and is between about 10 to about 70 degrees of displacement from the upward position to the lower and most-downward position. While the movement may be confined in the plane of the barrel, the size of the mobile mass itself need not be the same size as the barrel. Thus, a mobile mass that exceeds the diameter dimension of a selected barrel can be used. In fact, the shape of the mobile mass is essentially one of the designer's choice, only one of which is presented in the drawings here. Similarly, the designer may select one of many angles for the contact surfaces between the mobile mass and the mobile bolt. In fact, the contact need not be a direct contact, but linkages and rod can be used. The embodiments shown in the drawings all have a direct contact point between the mobile mass and the mobile bolt. A first angled surface of the mobile mass can forms an angle of between about 10 degrees and about 70 degrees with respect to a line perpendicular to the longitudinal axis of the barrel, for example. Other angles can be selected and ranges include 20-50, 10-30, 30-60, and any number of angles. Accordingly, the invention includes methods to vary the contact surfaces between the mobile mass and the mobile bolt, the number of contact surfaces, the angles of them, and the gap or play between the surfaces at the loaded position or other positions, in order to design an optimum system for a particular caliber, including an optimum muzzle-climb control and optimum firing rate.

In addition, the firearm can employ a mobile mass that has a partially hollowed central region configured to move over a part of the top frame extension that extends below the barrel. It can also be configured to cover a spring linked to the mobile mass, where the spring assembly is configured to assist the pivot movement of the mobile mass from a lower position to an upward position.

In another general aspect, the invention can be a firearm comprising a barrel having a firing end and a chambering end and a counter-acting mobile mass positioned below the barrel and at the firing end. The firearm includes a mobile bolt that is formed with a surface to contact and/or strike a surface of the mobile mass. The bolt generally has a forward and a rearward position and is capable of pushing against or striking the mobile mass at the forward position or during movement from its forward-most position to a rearward position. While a tight junction between the mobile mass and the mobile bolt is preferred in the cocked or loaded position, some play between the contact surfaces can be designed into any embodiment of the invention. The firearm also includes a top main frame formed to hold the barrel at the firing end of the top main frame, the top main frame comprising a surface for the mobile bolt to move from the forward to the rearward position along the axis of the barrel during the operation of the firearm. The frame also includes an extension aspect, at the top main frame near the barrel end, comprising a connection point for the mobile mass that is positioned below where the barrel is fixed to the frame. The extension is positioned at a fixed point at the firing end of the top main frame, and wherein the connection to the mobile mass allows the mobile mass to pivot downward from a cocked upward-most position to a lowered, downward-most position, and generally from near the barrel to away from the barrel. This movement is in reaction to the rearward movement of the mobile bolt after firing. The downward movement forced upon the mobile mass by the movement of the mobile bolt in reaction to firing counteracts the upward, muzzle climb recoil forces known in the art.

Having generally described the invention and its operation, we now refer to the drawings and the exemplary embodiments that follow. These are examples and not limitations of the scope of the invention.

BRIEF DESCRIPTION OF THE DRAWINGS

The invention will be revealed in more detail with the aid of realization examples represented by the following drawings. The drawings should not be taken as a limitation of the extent of the invention, but merely an optional design choice based upon the invention.

FIGS. 4*a*, 4*b*, and 4*c* show details of the mobile mass.

FIGS. 5*a* and 5*b* show the end-point restraining catch unit or catch sear.

FIGS. 6*a* and 6*b* show the cocking puller.

FIG. 7 shows the lever (came d'armament) that resides within the handle for the cocking puller.

EXEMPLARY DESCRIPTION OF THE INVENTION

The following description is an example of how the mechanisms of this invention could be realized, and referring particularly to a pistol or small caliber firearm. However, many other firearm sizes, types, and designs can be used in the alternative. This description is not designed to exhaustively detail all aspects of the invention, but is but to show one of the many embodiments possible. As discussed in this document, the directions "rear," forward," "rearward," downward," "upward" etc., refer to positions relative to the barrel of a firearm and from the perspective of an operator holding or firing the firearm, where the firing end of the barrel is forward and the chambering end rearward. The barrel also defines the axis of the barrel or a longitudinal axis of the barrel.

Figure 1A:
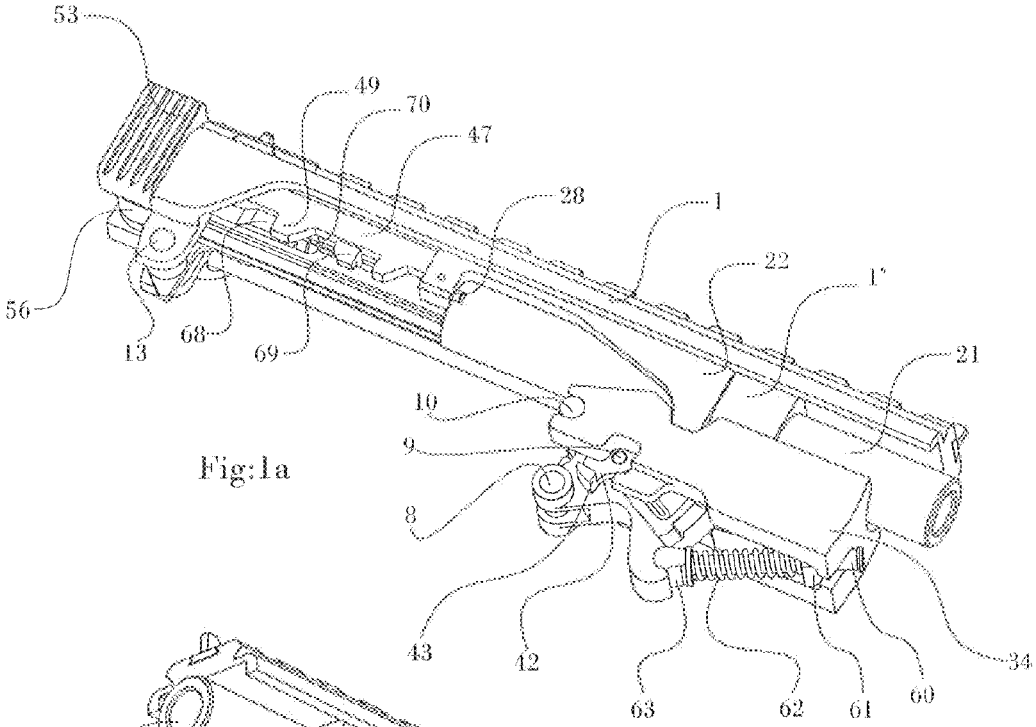
FIGS. 1*a*, 1*b*, and 1*c* show different angles of the ensemble of components that make up the delayed blowback device as they particularly interact with a top frame of a firearm.
Figure 1B:
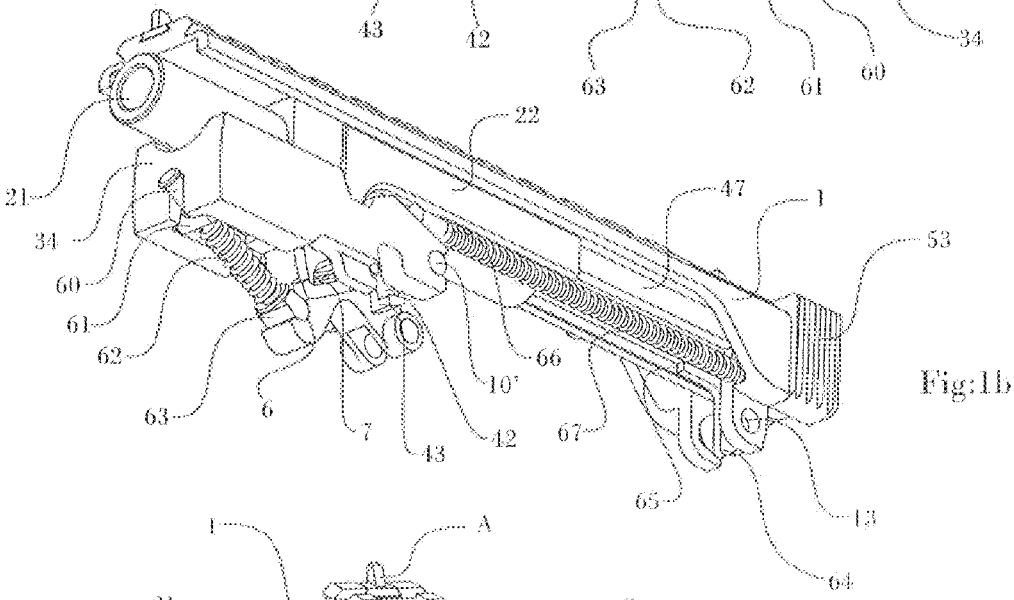
Figure 1C:
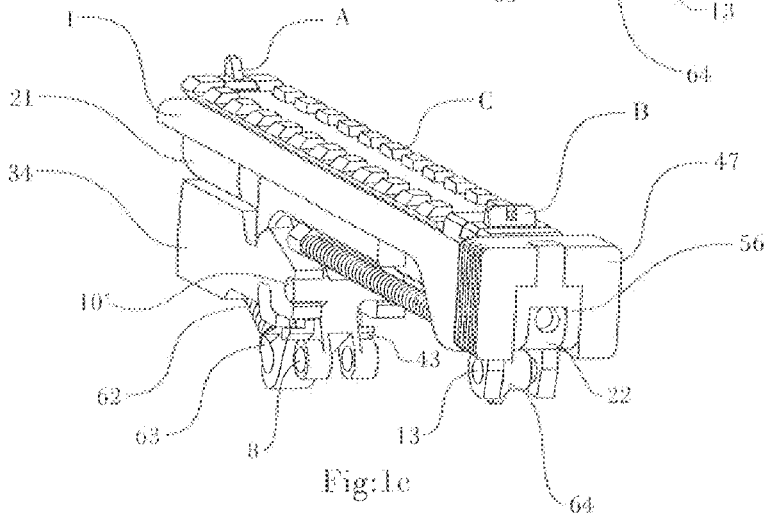
Figure 2A:
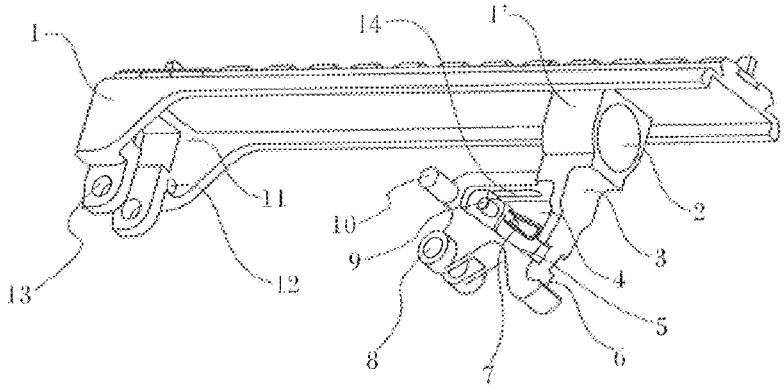
FIGS. 2*a* and 2*b* show an exemplary main frame in isolation, excluding the other principal mechanical elements.
Figure 2B:
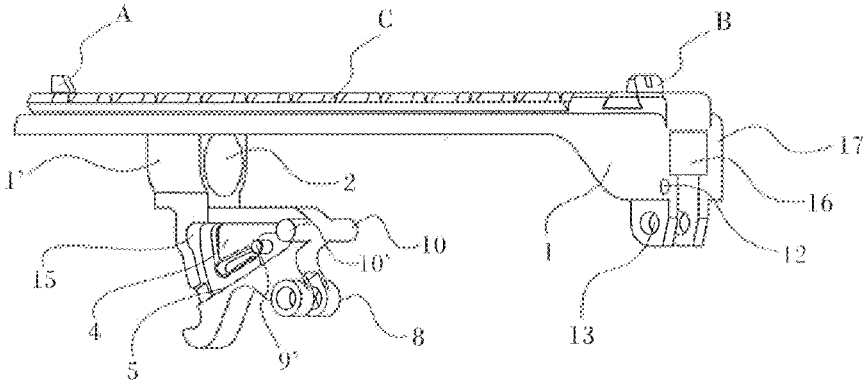
Figure 11:
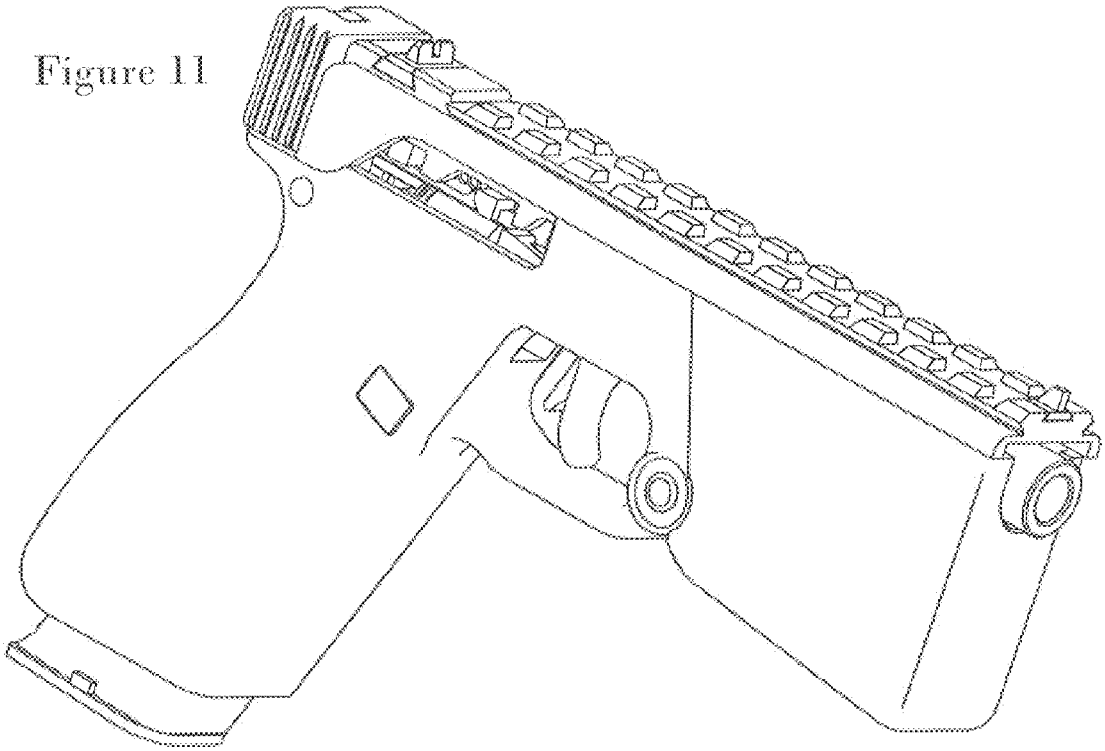
FIG. 11 shows an example of the invention incorporated into a pistol with covers or housings blocking the view of the mechanisms.
Figure 12:
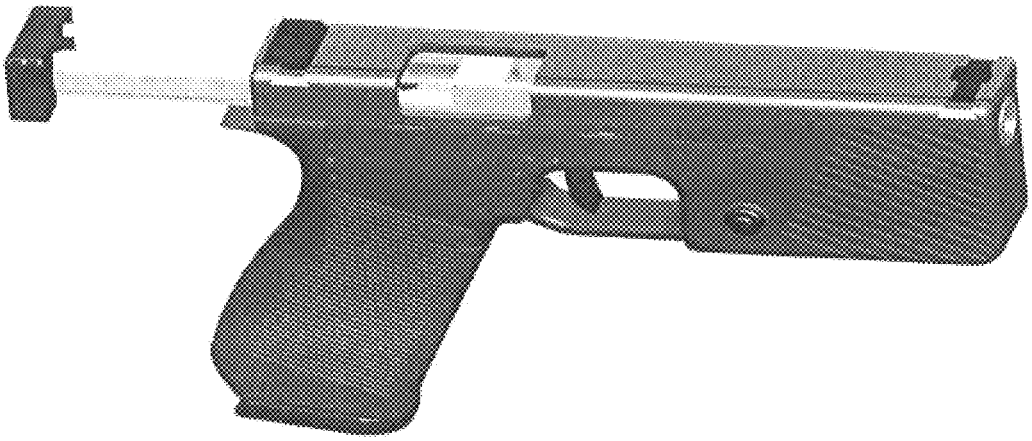
FIG. 12 depicts an exemplary pistol embodiment with cocking puller extended.

FIGS. 1*a*, 1*b* and 1*c* show the ensemble of parts comprising the delayed blowback device in a pistol format. This is composed of: a top main frame (1) unit and its extension (1') assembly, and as shown in FIGS. 2*a*, 2*b*, accommodating a barrel (21), which is optionally screwed into the top main frame (1) or attached by some other established means into the aperture housing (2) of the extension (1') of the frame. This part (1') is joined to the top main frame (1) either by manufacture or fabrication. It is fixed to the top main frame (1), and can be fixed, for example, by rivets, welding, or any other known assembly method. The top main frame (1) has a stirrup-shaped aperture (16) at its rear extremity, allowing the bolt-end (Q) to partially protrude during its backward movement, shown in FIG. 8*c* and FIG. 12. The rear extremity of the main frame (1) accommodates a bore (12) FIG. 2*b* for a barrel and can be positioned to allow the main spring guiding pin (66) to slide during the backward movement of the mobile bolt (22) and to allow restraint of the return spring (67), as in FIG. 1*b*. The top main frame (1) has two fixed pivot points provided by the bores (8) and (13), as in FIGS. 1*a*, 2*a*, it being possible to accommodate metal fixing pins or rods in any kind of automatic firearms frame whether pistol or other, as shown in FIG. 11, by way of example. The top main frame (1) can house, by way of manufacture or some other process, an attachment allowing rapid adaptation with a variety of sighting or lighting apparatus and/or other accessories known as a 'Picatinny rail' (C). The top main frame (1) is typically equipped with the usual aiming devices (A),(B) in FIG. 1*c*, particularly at each of its extremities.

Figure 3A:
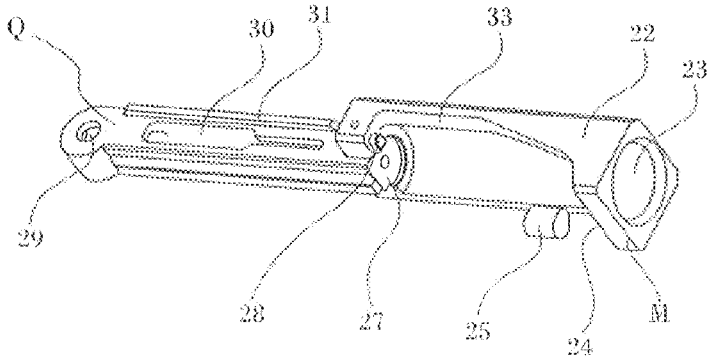
FIGS. 3*a* and 3*b* show details of the mobile bolt.
Figure 3B:
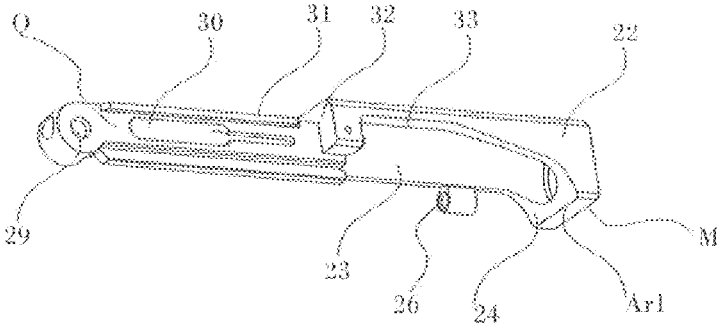
Figure 9A:
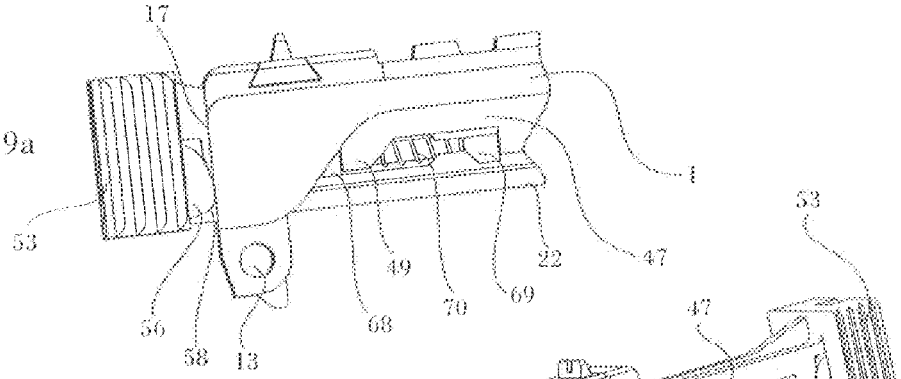
FIG. 9*a* shows the position of the overdrive lever during the action of the weapon.
Figure 9B:
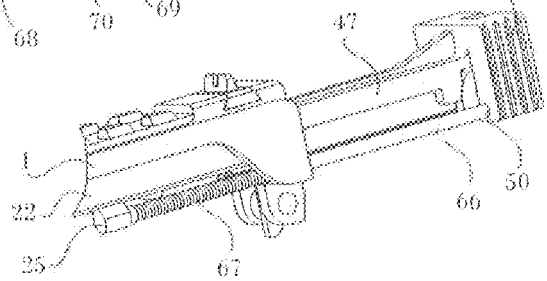
FIG. 9*b* shows the guiding pin (25) of the main spring in the rear-most position.

A mobile bolt (22) (FIGS. 3*a*, 3*b*) consists of a surface or bolt head (27) for engaging a cartridge, an extractor (28), a reception channel (30) for the firing pin, a catch pin (25) and its housing (26), and the head of the guiding pin (66) for the main spring (67), as in FIGS. 1*b*, 3*b*. The complete mobile bolt assembly (22) includes at its rear extremity, shown as the bolt end (Q), a bore hole (29) in FIGS. 3*a*, 3*b*, furnishing the pivoting axis point and fits with the holes (59) of lever (56), shown as the lever of FIG. 7. This lever (56) is used in cocking to ease the tension of the pressure required for the operator to cock the firearm. The bolt end (Q) is equipped with two guide rails (31) and (31') on each of its lateral surfaces and accommodating the cocking puller (47) extension, which slides between the two rails (31) and (31') of the bolt end (Q) by means of two grooves (48) and (48'), as shown in FIG. 6*a* and FIG. 3*a* or 3*b*. The bolt end (Q) also carries the return tappet (68) of the cocking puller (47) and its spring (not visible), shown in FIGS. 1*a*, 9. The mobile bolt (22) is equipped with an oblique surface or slope (24) (FIG. 3*b*) at end point (Ar1) obtained by construction and of which the angle of slope can be equal to or fitted to the angle selected for the primary slopes (37) and (37') of the mobile mass (34) (FIG. 4*b*), so that the sloped (24) projection of mobile bolt (22) fits into area of slopes (37) and (37') of mobile mass (34), as shown by the tight fit of the two contact surfaces of the mobile bolt (22) to the mobile mass (34) in FIG. 1*a*. The slope area continues through to straight area (33) in projection. The bore (23) in forward projection area (M) and (Ar1) of mobile bolt is designed for a particular barrel size.

On the mobile mass (34) (FIGS. 1*a*, 1*b*, 1*c* and FIGS. 4*a*, 4*b*, 4*c*) there are two primary slopes (37) and (37'), two secondary slopes (38) and (38'), and two guide planes (39) and (39')—all cut during manufacture. The selected angles for each of these slopes varies by design, by caliber employed, and by the desired rate of fire in automatic mode. All of the selected angles shown in the drawings are designed for a .45 caliber machine pistol, but all angles can vary by at least ±5° or at least ±10° or at least ±30° from those shown in the drawings here. The primary slopes (37) and (37') are the surfaces of the mobile mass that contact the mobile bolt surfaces during the backward movement of the mobile bolt immediately after firing to push the mobile mass into its downward pivoting movement. Thus, the contact surfaces must be designed so that the force of the backward movement of the mobile bolt allows the downward pivot of the mobile mass in reaction to firing, as that is the only operational limitation of the angles and design shapes chosen. As described above, these two surfaces are preferably machined to tightly fit against one another when in the position as in FIG. 1*a*, without any gaps caused by a difference in the angles or lengths of the surfaces. However, there is no requirement that the surfaces be as depicted in the drawings here.

The angle of the largest downward displacement of the mobile mass (34) can also be varied from that shown in the drawings. FIG. 8*c* shows the mobile mass at its furthest downward pivot position, which is approximately 20° to 30° from the line created by the axis of the barrel. Again, this angle can be selected based upon a number of design options, including caliber, weight of component parts, and rate of fire. Optionally, this downward displacement angle can be as high as 90°, but a range from about 20° to about 60° is preferable.

At its rear extremity, the mobile mass (34) has two semi-oblong notches (40) and (40') (FIG. 4*b*) to pivot on the tenons (10) and (10') (FIG. 1*a*), which tenons are part of the extension (1') of the top main frame (1), also shown in FIG. 2*a*. A cavity (35) and groove (35'), shown in view of mobile mass in FIG. 4*a*, for the guiding pin (60) of the mobile mass return spring (62), assembly shown in FIGS. 1*a* and 1*b*, are installed in the forward under part of mobile mass (34) to accommodate the guiding pin (60) of the mobile mass return spring (62) and its push plate (61), which push rod interacts at point (6) (FIG. 2*a*) of extension (1') and at the other end with rounded end (63) (FIG. 1*a*) of spring assembly. The mobile mass (34) can be constructed or fabricated to have two internal tenons (36) and (36') on the two internal lateral surfaces of the U-shaped cavity of the extreme rear of the mobile mass (34), shown in FIGS. 4*b* and 4*c*. These two internal tenons (36) and (36') have the function of stopping the mobile mass (34) at the end of its downward pivoting course, as shown in FIG. 8*c*, and striking against the surface (5) of the extension (1') of the top main frame (1), shown in FIGS. 2*a*, 2*b*, to prevent further downward travel of the mobile mass. The size and resistance provided by the mobile mass return spring (62) determines the force with which the mobile mass strikes at surface (5).

Figure 10A:
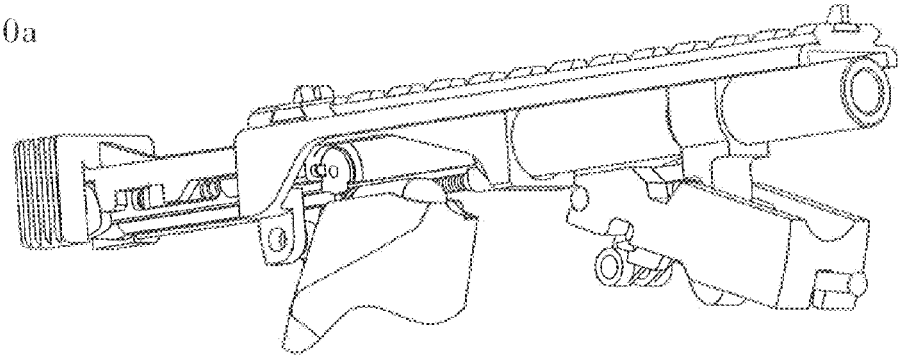
FIGS. 10*a*, 10*b*, 10*c* and 10*d* show the complete cycle of loading, firing, and ejection.
Figure 10B:
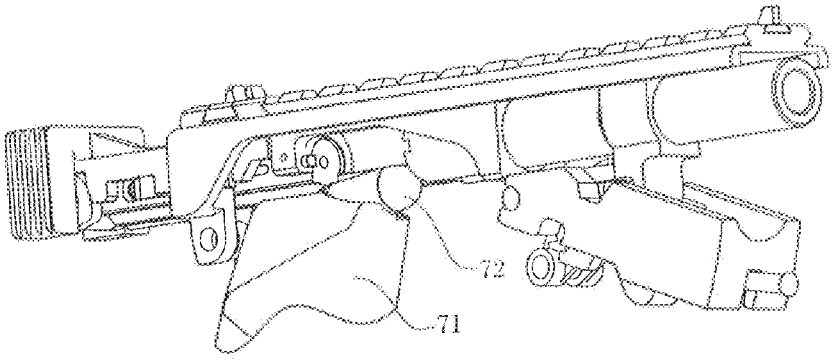
Figure 10C:
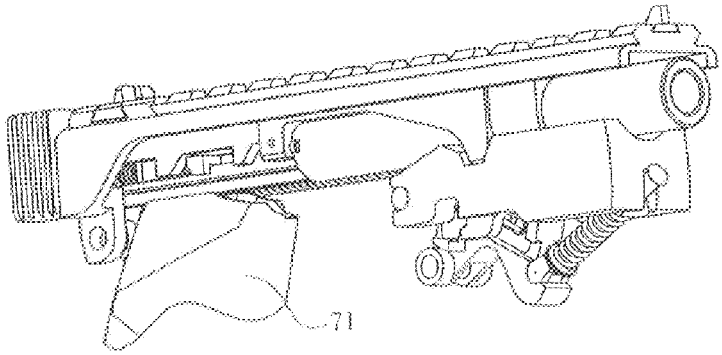

The restraining catch sear (42) of the mobile mass assembly is shown in FIG. 5*b*, and in another view in FIG. 5*a*. The extension (1') of the top main frame (1) carries a tenon (9) that forms the end-point of movement for restraining catch unit (42) for the mobile mass (34), allowing it to pivot, as shown in FIGS. 1*a* and 2*a*. The catch sear (42) is released by a 'pin' spring (7) positioned in the cavity (4) of the extension (1') of the main frame (1), shown in FIGS. 2*a*, 2*b*. Its upper part is in contact with the working lug (46) of FIG. 5*a*. The restraining catch unit (42), shown in FIGS. 5*a* and 5*b*, fits and pivots in the mobile mass (34) by the lower extremities (43) and (43') interacting with the two upper ridges (Ar) and (Ar') of the mobile mass (34), shown in FIG. 4*c*. The restraining catch sear assembly can be designed to restrain the speed of the upward pivot movement of the mobile mass (34) so that it coincides with the return movement of mobile bolt (20) and the correct surfaces can contact each other, as shown in the progression of movement in FIGS. 10*a*, 10*b*, and 10*c*, showing the loading of a round into the barrel chamber.

SYSTEM FUNCTION

Figure 10D:
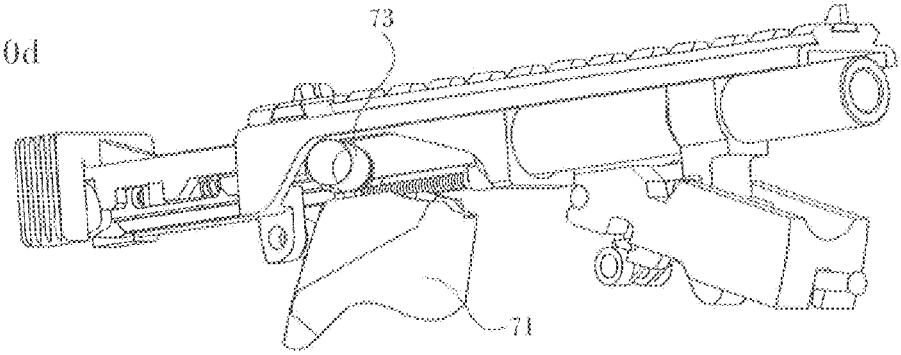

The cycle starts with the explosion of the powder charge contained in the cartridge casing in the barrel chamber. This propels the projectile through the barrel and then, through delayed blowback system, the mobile bolt (22), by means of its forward end section slope (24) surface, exerts a pressure on the surfaces (37) and (37') of the mobile mass (34), forcing the mobile mass to pivot downwards on the tenons (10) and (10'), which are part of the extension (1') of the main frame (1). FIG. 10*d* shows the mobile mass in the downward pivot position and a spent cartridge case (73) exiting. The mobile bolt (22) continues its backward movement while ejecting the fired cartridge casing and then comes to a stop by hitting the rear internal surface (11) (FIG. 2*a*) of the main frame (1). The violently propelled mobile mass (34) travels from top or upward-most position (FIG. 8*a*), parallel to the axis of the barrel, to a bottom-most position (FIG. 8*c*), and then is itself stopped by internal rods or tenons (36) and (36') contacting with the surfaces (5) and (5') (FIGS. 2*a*, 4*b*, 4*c*) of the extension (1') of the main frame (1). The abrupt stop of the mobile mass generates a counteracting force to the natural muzzle jump of the weapon.

The triggering device is not the object of this invention. An existing system of launching a firing pin with a symbolic triggering mechanism is shown here as "G" (FIG. 8*a*), by way of example, in order to facilitate a better comprehension of the text and figures they relate to.

Figure 8A:
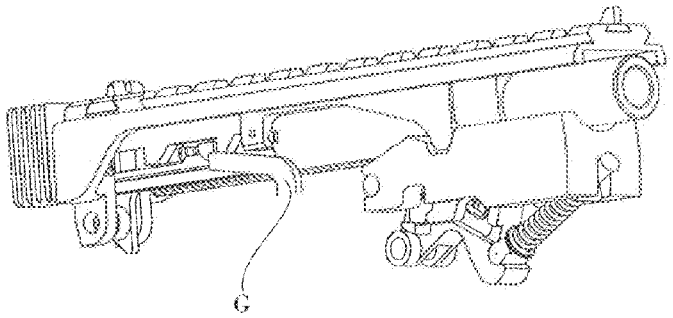
FIGS. 8*a*, 8*b*, and 8*c* show the working of the weapon mechanism. The element "G" generically represents a triggering mechanisms and its interaction with mechanism of the invention. The type of triggering mechanism selected for use is optional. The arrow at "F" represents the direction of movement of the cocking puller and bolt in reaction to firing.

The explanation of the working cycle can also begin with 'bolt closed' (FIG. 8*a*). The operator seizes the grooved section (53) of the cocking puller (47) between his fingers, FIGS. 1*a*, 1*b*, 1*c*, FIG. 5, FIG. 8*a*, then FIGS. 1*a*, 1*b*, 1*c*, FIG. 5, FIG. 8*a*. A backward force in the direction of the arrow (F) (FIG. 8*b*) moves the cocking puller (47) by sliding on the guide rails (31) and (31') fabricated in the end (Q) of the mobile bolt (22) by means of the grooves (48) and (48'). This forces the lever (56) to pivot on the axis carried by the bore (29) of the end (Q) of the mobile bolt (22), and crossing the bore (59) under pressure from the surface (54) cut into the interior of the cocking puller (47), shown in FIG. 6*b*, by action against the surface (57) of the upper extremity of the lever (56) of FIG. 7.

Figure 8B:
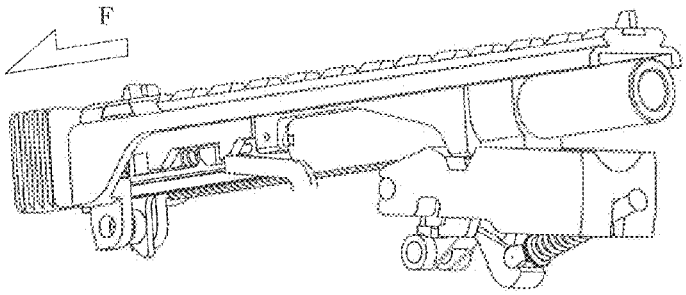
Figure 8C:
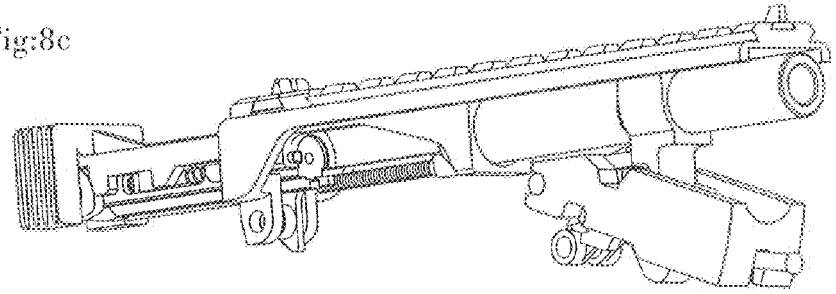

The traction exerted during this movement by the lower section (58) of the lever in contact with the surface (17) of the rear extremity of the main frame (1), shown in FIG. 2*b*, creates a leverage effect that can be greater than 5:1, as assists the operator in cocking the firearm even under the forces of the internal springs. This cocking action forcing the mobile bolt (22) to move slightly backward as in FIG. 8*b* compared to FIG. 8*a*. The cocking puller (47) is stopped in its backward movement by the lever (56), itself restrained by its axis positively linked to the end (Q) of the mobile bolt (22). During this displacement, the mobile mass (34) rotates towards the bottom, provoked by the slide of the slope (24) on the extreme front underside of the mobile bolt (22) and the slopes (37) and (37') of the mobile mass (34), seen in FIGS. 4*b*, 8*b*.

The cocked position of the mobile mass (34) presents dynamic resistance to the movement of the mobile bolt (22) corresponding to three principal factors, which are: the angles of the slope surfaces (37) and (37') (which can be represented as the angle formed between this surface and a perpendicular line down from the line formed by the longitudinal axis of the barrel of the firearm when the mobile mass is at its forward position as in FIGS. 1*a* and 8*a*); the force of the mobile mass return spring (62); and the bolt's weight. These factors make it possible to fine-tune forces and constraints for optimized operation of the mechanism characterizing this invention—whichever type of ammunition is used. The mobile bolt (22), still under the constraint of the traction effort generated by the user in cocking, forces the mobile mass (34) to pivot respectively on its semi-oblong notches (40) and (40') FIGS. 4*b*, 4*c*, and on its tenons (10) and (10') FIGS. 1*a*, 2*a*, housed in the extension (1') of the main frame (1).

The ridge (Ar1) of the slope (24), FIG. 3*b*, cut into the extreme underside of the mobile bolt (22) continues backwards, and slides on the secondary slopes (38) and (38') of the mobile mass (34). The angular value of these secondary slopes (38) and (38') is, in this position, less than about 60°, but can vary by design (again, the angle can be represented as that formed between this surface in FIGS. 1*a* and 8*a* and a perpendicular line down from the line formed by the longitudinal axis of the barrel the angle). The mobile mass (34) thus presents minimal resistance to the mobile bolt (22). Still moving backwards, the ridge (Ar1) of the slope (24) of the mobile bolt (22) intersects with the two upper ridges (Ar) and (Ar') (FIG. 4*c*) of the mobile mass (34). At this point, the mobile mass (34) reaches its lowest point of angular displacement—in the case of a pistol as presented in the present drawings, about 20°, or within ±10° or ±5° of 20° (compared to position parallel to the longitudinal axis of the barrel). This value is purely indicative of the caliber and size of firearm desired as in the drawings presented here, and naturally the value can vary depending on the construction and dimensions of the mechanism, the caliber and size of the firearm, and other design options, including the weight and mass of the mobile mass itself.

The mobile bolt (22) can continue its course backward translational movement sliding on the surfaces (39) and (39') of the mobile mass (34), shown in FIG. 4*b*, under the effect of the traction still exerted by the user who no longer has to combat the force of the main spring (67) FIG. 1*b*. As the mobile bolt (22) proceeds backwards, this translation releases the restraining catch sear unit (42) of the end-point of the mass (34), which under the effect of its spring (7) positioned in the cavity (4) of the extension (1') of the top main frame (1), in FIGS. 1*a*, 2*a*, engages its lower extremities (43) and (43'), in FIGS. 5*a*, 5*b* in the notches (41) and (41') cut into the surface of the mobile mass (34), as in FIG. 4*b*. The mobile mass (34) is thus locked into its lowest position. The mobile bolt (22) completes its backward movement striking with its surface (32) in FIG. 3*b* against the internal rear surface (11) of the top main frame (1), shown in FIG. 2*a*. The arming movement of the mobile bolt (22) is completed as shown in FIGS. 8*a*, 8*b* and 8*c*.

Three design possibilities are now present:

a) The gun does not have a magazine catch—the mobile bolt returns to its initial position under the effect of the main spring while the charger is not engaged.
b) The gun is equipped with a magazine catch—the mobile bolt and its components stay in the rear position if the magazine is empty or disengaged.
c) The gun's magazine is engaged and contains at least one cartridge.

Only this last case is discussed here.

The user releases the grooved extension (53) of the cocking puller (47) connected to the mobile bolt (22) through intermediary parts (i.e., lever (56)), positively connecting with the end (Q) of the mobile bolt (22) by a rod (not shown) through its bore (29) and the bore (59) of the lever (56) (FIG. 7). The mobile bolt (22) unit begins a forward translational movement under the pressure of the main spring (67) compressed between the internal surface (11) (FIG. 2*a*) of the rear extremity of the main frame (1) and the head of the guiding pin (66) of the main spring (67), the front end of which interlocks with the housing of the catch plate (26) (FIG. 3*b*) on pin (25) (FIG. 3*a*). In this movement forward, the mobile bolt (22) enters into contact with the bottom of the cartridge (72), usually held by the lips on magazine (71), and extracts a cartridge (72) from the magazine to load it into the barrel chamber, as in FIGS. 10*a*, 10*b*. At the same time, the cocking puller (47) returns to its initial position under the effect of the spring (not visible) of the return tappet (68) operating on the finger or peg projection (49) of the cocking puller (47). The mobile bolt finishes its movement forwards after having introduced the cartridge (72) into the barrel chamber. In the same movement, the bolt forward surface (M) (FIGS. 3*a*, 3*b*) enters into contact with the surface of the catch sear (42) (FIG. 5*a*) at point (44) while assembled into the mobile mass assembly, shown in FIGS. 1*a*, 8*a*, 8*b*, and 8*c*, forcing the catch sear (42) to fall by means of pivoting about its bore (45) on the rod (9) (FIG. 1*a*) of the extension (1') of the top main frame (1).

The catch sear (42) (FIGS. 5*a*, 5*b*) of the mobile mass assembly, as it rotates, releases its ends (43) and (43') into the notches (41) and (41') cut into the mobile mass, shown in FIGS. 4*a*, 4*b*, 4*c*. The mobile mass (34), under the impulse of its return spring (62) guided by the guiding pin (60) and in contact with the housing (6) of the extension (1') of the top main frame (1), is pushed by the push plate (61) into its initial position.

In this position, the mobile mass (34) wedges the mobile bolt (22) provoking contact between the primary slopes (37) and (37') of the mobile mass with the slope (24) of the mobile bolt (22) and the convex surface (3) (FIG. 2*a*) installed on the external forward surface of the extension (1') of the top main frame (1), as shown in FIG. 2*a*. Such a mechanical configuration naturally provokes a tightened position between the three principal components of the mechanism characterizing this invention; the mobile bolt (22), the mobile mass (34) and the main frame (1) (see FIGS. 1*a*, 1*b*, 1*c*). The use of this wedge effect or tightened configuration of component when loaded has the benefit of ensuring a perfect and constant headspace and lack of vibration during operation, and a degree of auto-compensation of the positioning of the mechanical during the normal play generated by high-speed functioning typical of this type of device. The firearm is now ready for firing.

The user, typically pressing on the end of the trigger with his finger, provokes the release of the firing pin catch (69) propelled by its spring (70) that strikes the cap of the cartridge in the chamber. We will not describe here the percussion device, it is mentioned in our reference to the use of a launched firing pin or triggering mechanism, but any other known system could be adapted and this is not within the precise remit of this invention. The ignition of the propelling charge contained in the cartridge and the expulsion of the projectile from the barrel (3) provokes a force of "counter reaction" acting, by intermediary of the rear surface or bottom of the casing (73) of the cartridge (72) FIGS. 10*b*, 10*d*, on the surface of the bolt head (27) of the mobile bolt (22). This force of "counter reaction" acts simultaneously and respectively on the surfaces of the primary slopes (37) and (37') of the mobile mass (34), held in place by its spring (62) and that of the slope (24) of the mobile bolt (22). This force of "counter reaction" translates in fact into a short, violent shock effect, approximately $^{30}/_{1000}{}^{th}$ second, acting on the parts mentioned above. The energy is thus almost instantly transmitted to the two mobile pieces which are, respectively, the mobile bolt (22) and the mobile mass (34). The angle value of the different contact surfaces or slopes on the mobile bolt (22) and the mobile mass (34) define the angular acceleration that is applied to the mobile mass (34) at the instant of the impulse of firing of the bullet. This angular speed, variable in its design, is relative to the power of the ammunition, the weight of the two principal mobile pieces, the strength of their respective springs, and the length of the barrel. Influencing any one of these values makes it possible to adjust the firing rate and the function of these parts. Under this shock effect, the mobile bolt (22) attempts to recoil but is braked in its backward course by the obstacle of the two primary slopes (37) and (37') of the mobile mass (34) against which slides the slope (24) of the mobile bolt (22). The angle of these slopes provokes an amplifying effect of movement that tends to project the mobile mass (34) perpendicularly to the mobile bolt's axis of pressure. Accordingly, these angles can be modified from those shown in the drawings and to accommodate different caliber ammunition and different sized firearms. The invention is not limited to any particular size or any particular ammunition.

During a particular phase of the cycle, the mechanical effort is supported by the slopes of the two mobile pieces and the convex surface (3) of the extension (1') of the main frame (1). The effect of the slope on the movement of the mobile mass (34) forces it to partially rotate around the tenons (10) and (10') built into the rear extremities of the extension (1') of the top main frame (1) by the intermediary of its notches (40) and (40'). The concave interior surface (35) of the mobile mass (34) (FIG. 4*c*) of which the radius is equal to that of the convex surface (3) of the extension (1') of the main frame (1), is constantly in contact with this during the expression of maximum mechanical effort.

In general, the mechanism of the invention comprises: a main frame accommodating a barrel; a mobile bolt capable of sliding in the frame; and a mobile mass capable of angular movement or downward pivoting action in relation to the horizontal axis of the barrel. The mechanism includes a mobile mass that can pivot on at least one tenon or rod, but preferably two, which are positioned behind the point where the slopes of the mobile bolt and mobile mass make contact. The invention includes a top main frame assembly equipped with an extension—which can be manufactured or assembled—supporting at least one pivot or tenon, but preferably two, and with a convex contact surface on its forward surface. The main frame houses at least one catch sear for the mobile mass connecting at the end-point and its return spring. The main frame is also equipped with at least two attachment points joining it to the receiver of any weapon, preferably an automatic pistol. The mobile mass of the invention has at least one primary slope with an angle equal to that installed on the front extremity of the mobile bolt while it is in the closed position.

The mobile mass may incorporate a manufactured concave surface with a radius equal to that of the convex surface of the extension of the main frame, and centers on the bearings positioned on the main frame extension. The mobile mass can accommodate at least one housing for its return spring. The mobile mass can pivot on at least one, preferably two, oblong groove(s) positioned at its rear extremity. The grooves allow the mobile mass a degree of liberty in relation to the X axis or axis of the barrel, positioning its concave surface to withstand the mechanical constraints generated on firing while still facilitating pivoting action. The mobile mass can be equipped with at least one lock on its lower part, but preferably two, to receive the catch sear surfaces or tip.

The catch sear for the mobile mass assembly can be positioned in the housings installed in the main frame extension and is capable of pivoting on an axis carried on the frame. The sear is activated by an elastic means or spring, itself positioned in one of the housings of the main frame extension, allowing its return to a working position.

The mobile bolt at the lower front end can have a sloped surface with an angle equal to that of the primary slopes of the mobile mass in closed position (FIG. 1*a*). The mobile bolt can be equipped with at least one extension, obtained by construction or assembly, which accommodates at least one return spring guiding pin head. Optionally, the mobile bolt can accommodate two guiding pins and two main springs. The mobile bolt at its rearward part can accommodate some means of percussion or a firing mechanism, composed principally of a spring and a firing pin, which is positioned in a bore installed inside the bolt unit or assembly. The mobile bolt at its rear extremity can have a bore which serves as a point of attachment and pivot for a lever for facilitating the cocking action. The mobile bolt at its rear part can have a means of guidance for a cocking puller or cocking assembly handle installed on its upper side. This is composed preferably of two rails, but could also be two grooves, a dovetail or other mechanical means fulfilling the same function. The cocking puller can slide by means of rails, grooves or other means on the rear extremity of the mobile bolt and, by moving backwards, activates a lever, which is itself supported by a bore installed in the mobile bolt, and the lever can have a pivotal action and interacts with the surfaces on the rear face of the main frame. Activated by the cocking puller, the lever facilitates the release of the mobile bolt from the grip of the mobile mass and its spring during the user's manual cocking and activation of the firearm.

In general, a mechanism of the invention can comprise at least a mobile mass elastic return means or spring, with one end in contact with a stop or rest surface located on a point of the main frame extension, and the other end on the interior front surface of a housing machined into the mobile mass.

The claims that follow exemplify the invention but should not be considered a limitation of the invention in any sense. Many embodiments of the invention are possible from the description and information provided here.

We claim:

1. A recoil control device for use in a firearm comprising a counteracting mobile mass; a mobile bolt configured to move from forward to rearward and a rearward to forward position during operation; the counteracting mobile mass configured to pivot from a cocked position to a second position, and having a surface to contact the mobile bolt during its movement; a receiver comprising a top main frame part configured to allow the movement of the mobile mass from a forward and cocked position to a rearward position while confining the mobile bolt within the axis of the barrel, the top main frame part of the receiver further comprising a forward extension assembly for connecting the mobile mass forward of the chambering end of a barrel of the firearm, the connection to the mobile mass allowing the mobile mass to pivot, wherein the mobile bolt comprises a projection that contacts the mobile mass at a first angled surface of the mobile mass during the movement of the mobile bolt, and upon firing of the firearm directs the pivoting movement of the mobile mass away from the barrel and wherein the movement of the mobile mass counteracts the recoil forces upon firing.

2. The device of claim 1, wherein the first angled surface of the mobile mass joins a surface of the mobile bolt so that substantially no gaps exist along the length of the first angled surface of the mobile mass when the firearm is in the loaded or cocked position.

3. The device of claim 1, wherein the mobile mass has first and second angled surfaces, the first angled surface contacting a surface of the mobile bolt immediately after firing.

4. The device of claim 1, further comprising a main spring linked to the mobile bolt and configured to assist the backward to forward movement of the mobile bolt.

5. The device of claim 1, further comprising a spring linked to the mobile mass and configured to assist the pivoting movement.

6. The device of claim 1, further comprising a spring-loaded catch sear linked to the mobile mass capable of temporarily locking the mobile mass from pivoting.

7. The device of claim 1, wherein the pivoting movement of the mobile mass is in the same plane defined by the barrel of the firearm.

8. The device of claim 1, wherein the first angled surface of the mobile mass forms an angle of between about 10 degrees and about 70 degrees with respect to a line perpendicular to the longitudinal axis of the barrel.

9. The device of claim 1, wherein the mobile mass has a partially hollowed central region configured to move over a part of the top frame extension that extends below the barrel, and a spring linked to the mobile mass and configured to assist the pivot movement of the mobile mass from a lower position to an upward position.

10. The device of claim 1, wherein the receiver comprising the forward extension assembly comprises a pivot point for the mobile mass and a pivot point for a catch sear, wherein the catch sear is linked to the mobile mass and is capable of temporarily preventing the mobile mass from pivoting upward into a loaded position through a restraining spring.

* * * * *